United States Patent [19]

Kawata

[11] Patent Number: 4,615,364

[45] Date of Patent: Oct. 7, 1986

[54] DEVELOPER INCOMING DEVICE IN ELECTROSTATIC REPRODUCING APPARATUS

[75] Inventor: Shun Kawata, Tokyo, Japan

[73] Assignee: Konishiroku Photo Industry Co., Ltd., Tokyo, Japan

[21] Appl. No.: 503,891

[22] Filed: Jun. 13, 1983

[30] Foreign Application Priority Data

| | | | |
|---|---|---|---|
| Jun. 23, 1982 | [JP] | Japan | 57-94874[U] |
| Jun. 28, 1982 | [JP] | Japan | 57-98733[U] |
| Jun. 28, 1982 | [JP] | Japan | 57-98734[U] |
| Jun. 28, 1982 | [JP] | Japan | 57-98735[U] |
| Jun. 28, 1982 | [JP] | Japan | 57-98736[U] |
| Jun. 29, 1982 | [JP] | Japan | 57-98656[U] |
| Jun. 29, 1982 | [JP] | Japan | 57-98657[U] |
| Jun. 29, 1982 | [JP] | Japan | 57-98658[U] |
| Jul. 1, 1982 | [JP] | Japan | 57-114971 |
| Jul. 1, 1982 | [JP] | Japan | 57-114972 |

[51] Int. Cl.[4] ..... B65B 1/04

[52] U.S. Cl. ..... 141/364; 222/167; 222/513; 222/DIG. 1

[58] Field of Search ..... 222/511, 513, 516, DIG. 1, 222/167; 141/348, 349, 350, 354, 364–366, 372, 383, 386, 363

[56] References Cited

U.S. PATENT DOCUMENTS

| | | | |
|---|---|---|---|
| 2,311,708 | 2/1943 | Sundholm | 141/350 X |
| 3,526,341 | 9/1970 | Johnston | 222/167 |
| 3,871,522 | 3/1975 | Feldman | 222/513 X |
| 3,915,208 | 10/1975 | Anderson | 222/DIG. 1 X |
| 4,060,105 | 11/1977 | Feldeisen et al. | 222/DIG. 1 X |
| 4,141,461 | 2/1979 | LaChance | 222/513 X |
| 4,307,763 | 12/1981 | Wang | 141/364 |
| 4,319,700 | 3/1982 | Celender et al. | 222/511 |

FOREIGN PATENT DOCUMENTS

| | | | |
|---|---|---|---|
| 0032986 | 8/1981 | European Pat. Off. | 222/DIG. 1 |

*Primary Examiner*—Joseph J. Rolla
*Assistant Examiner*—Michael S. Huppert
*Attorney, Agent, or Firm*—James E. Nilles

[57] ABSTRACT

A powdered developer supplying device in an electrostatic reproducing apparatus comprises a developer hopper and a developer receptacle. A cover for opening and closing a developer inlet opening of the developer receptacle is urged by a spring in the close direction. When the receptacle is installed on the hopper, the cover is opened by an operating member which is operated by the developer receptacle. A limiting member is provided for limiting movement of the cover from open/close positions. A bayonet type coupling member is provided for coupling the receptacle to the hopper by rotation after the receptacle is installed on the hopper. A developer receptacle wall which forms the bottom of the receptacle when the latter is up-ended at the time developer is being supplied is formed on a slope to facilitate flow of the powdered developer from the receptacle, through the opening into the hopper.

16 Claims, 32 Drawing Figures

DEVELOPER INCOMING DEVICE IN ELECTROSTATIC REPRODUCING APPARATUS

BACKGROUND OF THE INVENTION

1. Field of the Invention

This invention relates to an improvement in a developer receptacle used for supplying a dry developer in an electrostatic reproducing apparatus or the like.

2. Description of the Prior Art

In an electrostatic reproducing apparatus using a dry two-component developer or one-component developer, a certain amount of the developer is consumed during each copying operation, and therefore additional developer must be supplied after a multitude of sheets are copied. Additional developer is generally supplied to a developer incoming device (hopper) of the electrostatic reproducing apparatus from a dry developer receptacle in which developer is contained. The developer is a powdery material 10-odd microns in average particle size and hence is easy to scatter. Therefore, it is capable of flowing out or scattering to contaminate the surrounding area when the developer is supplied to an incoming port of the hopper from the developer receptacle. Further, when the receptacle is inclined or moved, some of the developer becomes a suspended mist in the receptacle. Therefore, the developer receptacle needs to have such a construction that the developer suspended therein will not come out of an opening, and that the opening can easily be opened and closed. It is also necessary that the developer flow out of the opening smoothly and not be scattered, due to collision of the particles with each other. In addition, operating efficiency must be provided so that the opening is normally kept closed to prevent the developer from leaving the receptacle when the developer receptacle is brought down by mistake, and so that the receptacle is easily opened when the developer receptacle is fitted onto the hopper to allow the developer to come into the hopper from the receptacle. The developer receptacle must be mounted correctly on the hopper, the developer receptacle and the hopper must both be kept closed when the developer receptacle is being installed on the hopper, both must be kept open when toner is being supplied, and the means which accomplish these objectives must be actuated correctly by a simple operation.

SUMMARY OF THE INVENTION

It is an object of this invention to provide such a hopper as will prevent developer from exiting or scattering therefrom during normal operation, and particularly when the hopper is being supplied with developer from a developer receptacle. The above object can be attained by a hopper in an electrostatic reproducing apparatus which is characterized in that a cover is provided to open and close an opening of the hopper, and the cover is biased by a spring in the closed direction.

The above object can be further attained by a hopper for receiving a developer in an electrostatic reproducing apparatus, which hopper has a movable cover capable of changing the developer incoming opening to an open position and a close position, which is characterized in that an operating member is provided on the cover to cause the opening to assure the open condition by a developer receptacle installed on a developer incoming device.

The above object can be further attained by a developer feeding hopper in an electrostatic reproducing apparatus having two covers, each provided with a developer feeding opening, and having means for operating the developer feeding openings by moving the two covers relative to each other, which is characterized in that a limiting member for limiting movement from close position is provided between the two covers.

Further, the above object can also be attained by a dry developer receptacle which comprises an inner cover and an outer cover, each provided with an opening, the two covers being movable correlatively, and adapted for discharging developer in the receptacle by matching the openings, and for closing a discharge hole by shifting the openings relative to each other.

Further, the above object can be attained by a developer receptacle having an inner cover and an outer cover provided with an opening in each and being movable relatively, and thereby forming a developer outgoing opening by matching the openings of the two covers, and closing the developer outgoing opening by shifting the openings of the two covers, which is characterized in that a sealing buffer member is interposed between the two covers.

Another object of this invention is to provide a developer receptacle which has a satisfactory sealing property, prevents developer from leaking externally and is also superior in operating efficiency when developer is being supplied to a hopper from the developer receptacle.

The above object can be attained by a developer receptacle having an inner cover and an outer cover, each provided with an opening and movable relatively, which is characterized in that either one of the covers is movable after intalling the developer receptacle on a machine body, while the other cover is stopped with a stop member provided on said body, and an operating member is provided for limiting movement of the other cover.

The above object can also be attained by a developer receptacle having a movable cover for closing a developer outgoing opening, which is characterized in that a spring is provided for biasing the movable cover to normally closed position.

A further object of this invention is to provide a developer receptacle which allows a developer to flow into a hopper smoothly. The above object can be attained by a developer receptacle having a developer drop hole, which receptacle is characterized in that a developer receptacle wall, which forms a bottom at the time developer is being supplied, is formed as an inclined plane in which said drop hole is located.

The above object can be attained by a supplying method for developer which is characterized in that a plurality of developer discharge holes are formed on a plane forming a developer discharge part, wherein developer being supplied is allowed to flow into an apparatus body through one of the discharge holes by inclining the discharge plane, and air is made to flow backward, through the other discharge hole.

A further object of this invention is to provide a developer feeder which is simple in operation at the time of toner supply, accurate in actuation and free from producing a toner stain when a hopper is being supplied with a developer.

The above object can be attained by a developer feeder in an electrostatic reproducing apparatus which is characterized in that a first movable cover and a first operating member are provided on a developer receptacle, and a second movable cover and a second operating member are provided on an electrostatic reproducing apparatus. In use, the first operating member operates on the second movable cover and the second operating member operates on the first movable cover when the developer receptacle is installed on the electrostatic reproducing apparatus. Thus, the first and the second movable covers are moved to form an opening through which the developer flows from the developer receptacle to the electrostatic reproducing apparatus.

DESCRIPTION OF THE PREFERRED EMBODIMENTS

Figure 1:
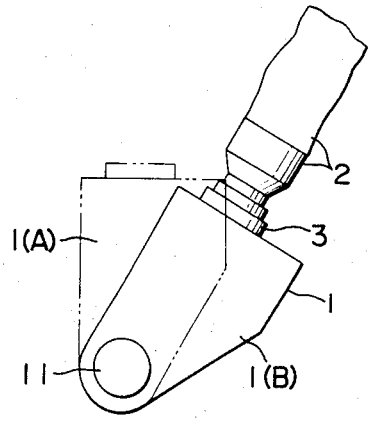
FIG. 1 is a side view of a hopper of electrostatic reproducing apparatus on which is mounted a developer receptacle.

FIG. 1 is a side view of a developer receptacle 2 mounted on a hopper 1 of electrostatic reproducing apparatus according to this invention. The arrangement is such that hopper 1 is rotatable at a constant angle round a hopper shaft 11, and a developer is supplied after the hopper 1 is brought down from a position 1(A) wherein it is in a working state to a position 1(B). The hopper 1 has a developer feeding opening 3, which is disclosed as a bayonet type, and the developer receptacle 2 mounted thereon has also a bayonet coupling member, thus ensuring that the developer receptacle 2 is in a fixed position after the receptacle 2 is mounted on the opening 3 of the hopper 1.

Before explaining the hopper 1 which is disclosed in connection with one embodiment of this invention, a description will be given of the developer receptacle 2 installed on the developer input opening 3 of the hopper 1.

Figure 2A:
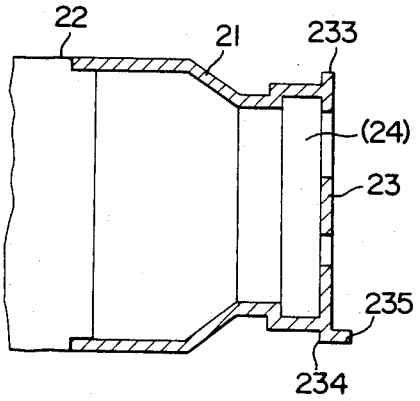
FIG. 2(*a*) is a sectional view representing the state wherein an outer cover and a developer housing part are mounted on a developer discharge part of the developer receptacle, and FIG. 2(*b*) is a front view thereof.
Figure 2B:
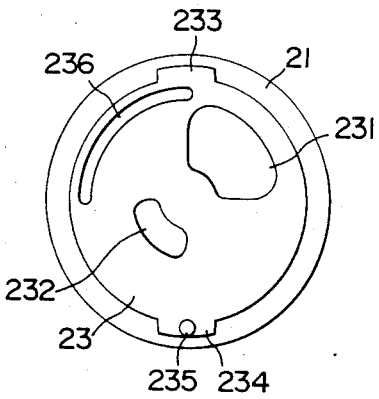

FIG. 2(*a*) is a sectional view showing that an outer cover 23 and a developer receiving part 22 are formed on a developer discharge part 21, and FIG. 2(*b*) is a front view thereof. In the drawings, the numeral 21 denotes a developer discharge part which is formed of a rigid resin. The developer receiving part 22 extending from the developer discharge part 21 is arranged in a bag of fabric or resin film and is coupled closely to the developer discharge part 21, and thus the developer will not leak out of the junction. The outer cover 23 is arranged at the nose of the developer discharge part 21. The outer cover 23, which is disklike, is formed of rigid resin and, after an inner cover 24, which will be described later, is inserted rotatably in the developer discharge part 21, the outer cover 23 is fixed to the developer discharge part 21 through adhesion or close fitting. The outer cover 23 has two openings 231, 232, almost at symmetrical positions, and a plurality of bayonet-shaped projections 233, 234 are provided on the disklike circumference to serve as coupling members to the hopper 1. Further, a projection 235, which serves as an operating member to open or close the movable cover of the hopper 1, and a slot 236, of concentric arcuate shape, are provided on the outer cover 23.

Figure 3A:
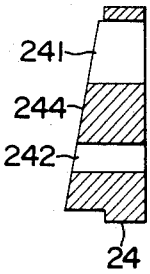
FIG. 3(*a*) is a sectional view representing an inner cover of the developer receptacle, and FIG. 3(*b*) is a plan view thereof.
Figure 3B:
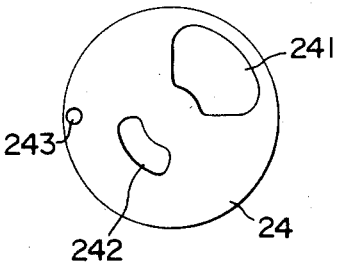

FIG. 3(*a*) is a sectional view of inner cover 24, and FIG. 3(*b*) is a plan view thereof. The inner cover 24 is a disk which tapers as at 244 in thickness and is fitted in the developer discharge part 21 so as to be rotatable externally. Two openings 241, 242, corresponding to and the same in arrangement and shape as the openings 231, 232 of the outer cover 23, are provided on the inner cover 24 almost at symmetrical positions. The opening 241 has a large aperture as compared with the opening 242 in order to function as a discharge port for the developer and is provided on the thinner wall side of the inner cover 24 having the taper 244. Then, a blind hole 243 is provided on the inner cover 24 at the corresponding position of the slot 236 of the outer cover 23.

Figure 4A:
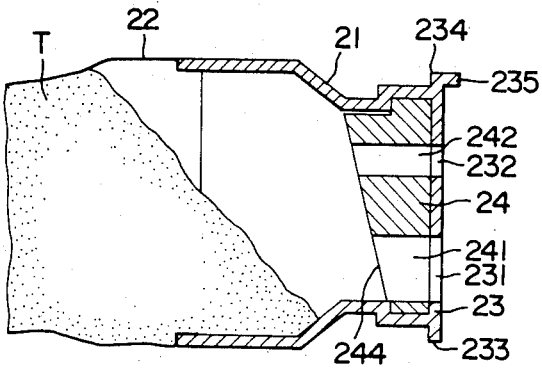
FIG. 4(*a*) is a sectional view representing a developer receptacle mounted on a hopper according to this invention, and FIGS. 4(*b*), 4(*c*) are front views thereof.
Figure 4B:
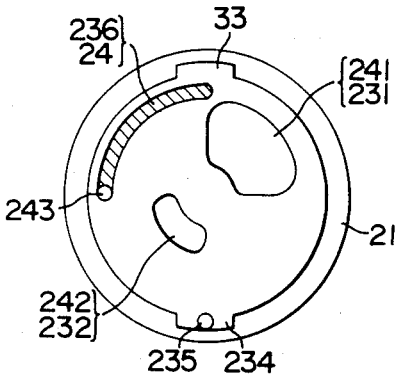
Figure 4C:
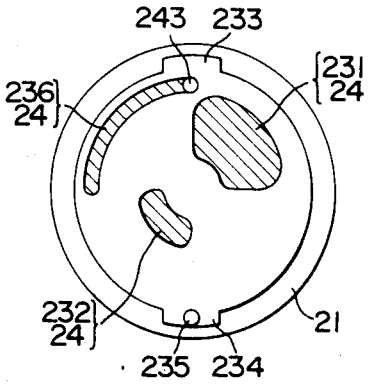

FIG. 4(*a*) is a sectional view representing a dry developer receptacle of this device which uses parts shown in FIGS. 2(*a*), 2(*b*) and FIGS. 3(*a*), 3(*b*), and FIGS. 4(*b*), 4(*c*) are front views of two embodiments. When a projection 315 (FIG. 5(*a*)) which will be described later is inserted in the blind hole 243 and turned relatively to the developer discharge part 21 from one end to the other along the slot 236, the inner cover 24 rotates relative to the outer cover 23 to positions as illustrated in FIG. 4(*b*) and FIG. 4(*c*).

In FIG. 4(*b*), the openings 231, 241 and the openings 232, 242 of the outer cover 23 and the inner cover 24 are matched to coincide with each other, and thus a developer T in the dry developer receptacle can be discharged through the openings 231, 241 which have a large aperture. Then, when the blind hole 243 is turned to the position shown in FIG. 4(*c*), the openings 231, 232 of the outer cover 23 and the openings 241, 242 of the inner cover 24 do not entirely come to coincide and are completely closed, therefore any developer T in the dry developer receptacle, which is kept inclined, will not leak out to the exterior.

Figure 5A:
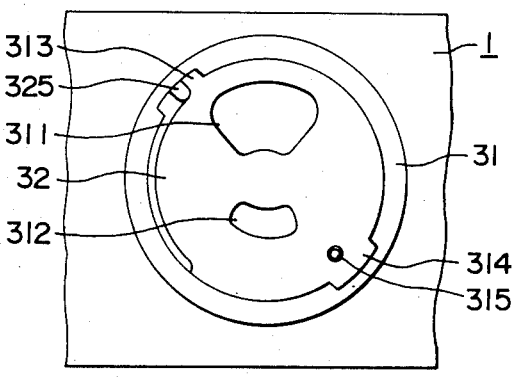
FIG. 5(*a*) is a front view representing a hopper opening according to this invention, FIG. 5(*b*) is a sectional view, and FIG. 5(*c*) is a rear elevation.
Figure 5B:
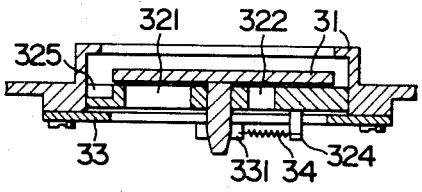
Figure 5C:
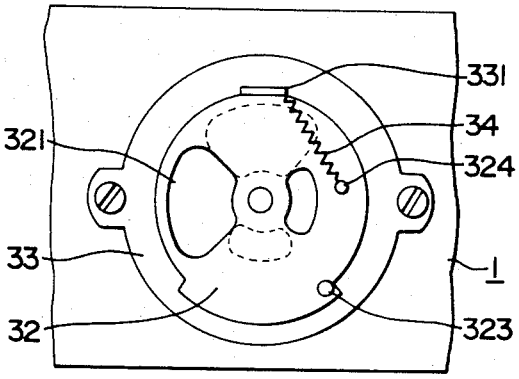
Figure 6A:
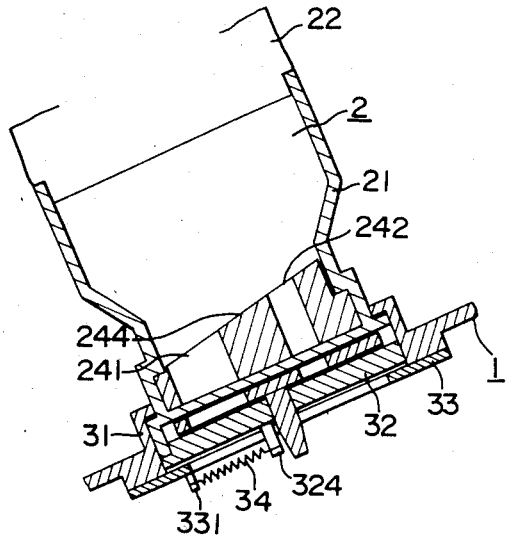
FIG. 6(*a*) is a sectional view representing the state wherein the developer receptacle is mounted on a hopper according to this invention, FIG. 6(*b*) is a sectional view representing the state wherein a developer is supplied, and FIGS. 6(*c*), 6(*d*), 6(*e*) are comparative drawings showing developer streamlined flow.
Figure 6B:
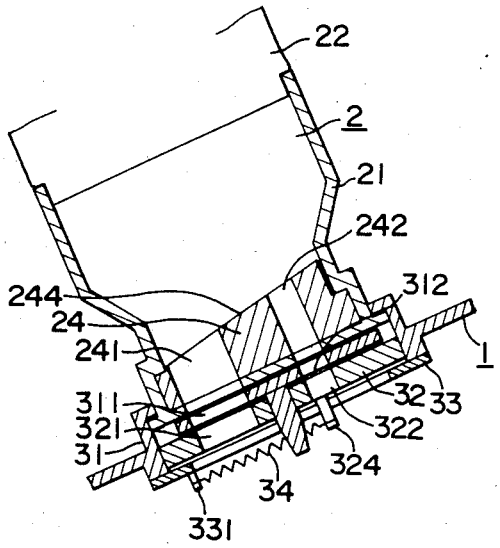
Figure 6C:
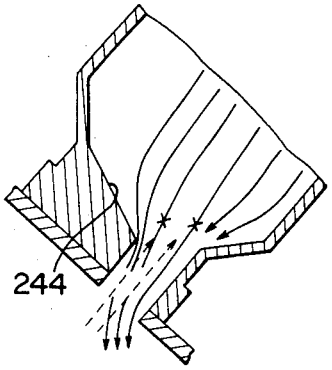
Figure 6D:
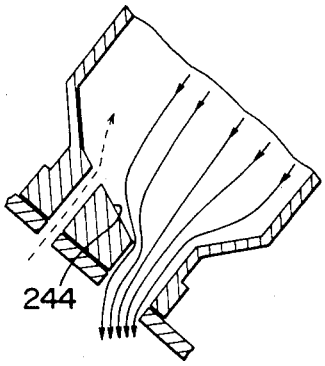
Figure 6E:
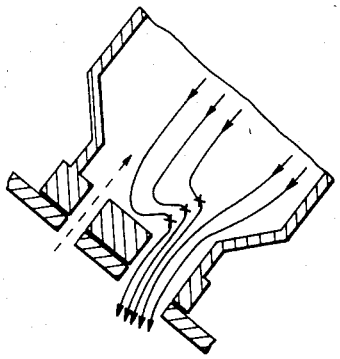

Next, the structure of the developer feeding opening 3 of the hopper 1 according to this device will be described, and then will be described operation at the time of developer supply with the developer receptacle 2 mounted on the opening 3. FIG. 5(*a*) is a front view of the opening 3 of the hopper 1, FIG. 5(*b*) is a sectional view, and FIG. 5(*c*) is a rear elevation view taken from inside the hopper 1.

An opening body 31 has two apertures 311, 312, corresponding to and the same in arrangement and shape as the openings 231, 232 of the developer receptacle 2, and body 31 also has bayonets 313, 314. There is a disklike movable cover 32 fitted in the opening body 31, and the movable cover 32 is mounted for rotation only by a retaining plate 33 fixed on the opening body 31. Two apertures 321, 322, the same in arrangement and shape as the apertures 311, 312, are provided on the movable cover 32, and a projection 323 is provided on the movable cover 32 which is operable for limiting the revolution thereof with respect to the retaining plate 33. A spring 34, biased according to this invention, is provided between a projection 324 provided on the movable cover 32 and another projection 331 provided on the opening body 31 or the retaining plate 33. The movable cover 32 is rotated normally as far as a stopper position of the projection 323 by operation of the spring 34 and is brought to a standstill there. Thus, the apertures 311, 312 of the opening body 31 and the apertures 321, 322 of the movable cover 32 will never coincide with each other, and are kept close to the state shown in FIG. 5(*c*).

FIG. 6(*a*) is a sectional view representing the state wherein the developer receptacle 2 is mounted on the hopper 1. The bayonet form projections 233, 234 of the developer receptacle 2 and the bayonets 313, 314 of the opening body 31 of the hopper 1 are formed to engage with each other. Therefore, the developer discharge part 21 of the developer receptacle 2 and the opening body 31 of the hopper 1 are first mated by engaging the bayonets to enable subsequent supply of the developer. Simply inserting the bayonets each other will still leave the hopper 1 and the developer receptacle 2 closed both. However, the projection 235 provided on the outer cover 23 of the developer receptacle 2 has been engaged with a groove 325 provided on the movable cover 32 of the hopper 1. Further, the projection 315 provided on the opening body 31 of the hopper 1 has also been engaged with the blind hole 243 of the inner cover 24 through the slot 236 of the outer cover 23 of the developer discharge part 21 as an operating member. Therefore, when the developer discharge part 21 is turned counterclockwise on the figure to bayonet fitting for installing the developer receptacle 2, the movable cover 32 of the hopper 1 is turned in accordance with the rotation of the developer discharge part 21. On the other hand, since the inner cover 24 in the developer discharge part 21 has been engaged with the projection 315 provided on the opening body 31 of the hopper 1, it will never be turned, even as a result of turning the developer discharge part 21. Therefore, when the developer discharge part 21 is turned against the bias of the spring 34, the inner cover 32 of the hopper 1 rotates together with the developer discharge part 21, and then comes to stop at a position regulated by the projection 323. FIG. 6(*b*) illustrates the state wherein the hopper 1 is automatically opened at the same time as when the developer receptacle 2 is opened, and the aperture position of the developer discharge part 21 coincides with the aperture position of the opening body 31 of the hopper 1, and thus the developer in the receptacle 2 flows out into the hopper 1.

As described above, the hopper according to this device has a movable cover which is slidably mounted on the opening body and is kept closed normally by the energized spring. The movable cover is then constituted to be movable in the opening direction by the operating member provided on the developer receptacle when installing the developer receptacle on the hopper. Therefore, the hopper according to this device not only prevents the developer from leaking out at the time of supply, to say nothing of leakage during ordinary service, but is also superior in operating efficiency.

Furthermore, the movable cover of the hopper in this embodiment has been constituted to include a rotatable slide member. However, a movable cover sliding linearly and a spring operating normally in the close direction may be provided between the movable cover and the opening body. When the movable cover is to be actuated to open position by installation of the developer receptacle, then such constitution may be included in this device.

Moreover, the developer receptacle of this device, which has been described above, has bayonets on the outer cover, and therefore, it can easily be coupled with the hopper simply by turning the outer cover. Then, the inner cover of the developer receptacle is stopped by a stop member provided on the hopper by turning the inner cover of the hopper, thereby opening both the developer receptacle and the hopper concurrently. Thus, the operation is very simple and a superior effect is achieved as well, in that the developer will never leak out externally.

Further, in this embodiment, the inner cover of the developer receptacle is fixed and the outer cover is turned for coupling the developer receptacle with the hopper. However, it is also conceivable that, conversely, the bayonet is provided on the inner cover of the developer receptacle, the outer cover is fixed, and the inner cover is turned to effect coupling.

Further, in this device, the toner in the developer receptacle is discharged through a lower side discharge hole and air is allowed to flow backward through an upper side discharge hole, thus affording an exclusive discharge hole for each of them, and a route through which the toner outflow becomes smooth and streamlined, thus preventing scatter of misty toner. On the other hand, as shown in FIG. 6(*c*), where only one discharge hole is provided, the falling toner and the back-flowing air collide with each other, the toner does not flow smoothly, and scatter of misty toner occurs.

In this device, moreover, the wall surface forming the bottom of the developer receptacle 2 during developer supply has a taper (slope) 244 in a direction which smooths outflow of the developer and, therefore, the developer can be discharged smoothly and scatter of the developer is minimized. FIGS. 6(*d*), 6(*e*) illustrate the circumstances described above. FIG. 6(*d*) indicates a condition wherein the bottom at the time of developer supply is arranged in a slope, and the developer particle outflow is streamlined, as illustrated, and is discharged smoothly and much more satisfactorily. However, in case the bottom has no slope, as shown in FIG. 6(*e*), the developer particles rebound to collide with the bottom and then collide with newly falling developer. Streamlining is thus disturbed, developer particle mist is suspended in the developer receptacle, the developer does not flow smoothly out of the discharge port, and the developer scatters more in the hopper 1.

As described above, the developer flows smoothly into the hopper according to this invention, and a remarkable improvement has been observed with reference to scatter of the developer and other phenomena.

Figure 7A:
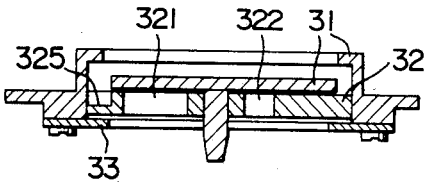
FIG. 7(*a*) is a sectional view representing a hopper opening according to another embodiment of this invention, and FIGS. 7(*b*) and 7(*c*) are rear elevations thereof.
Figure 7B:
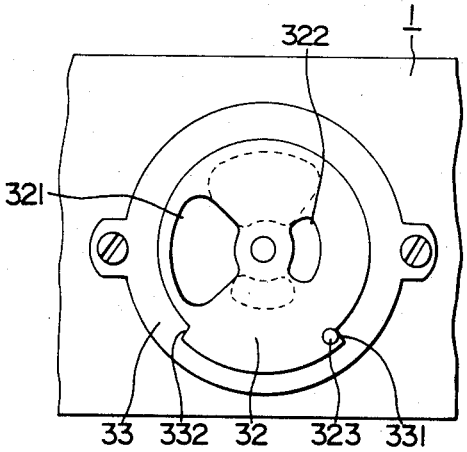
Figure 7C:
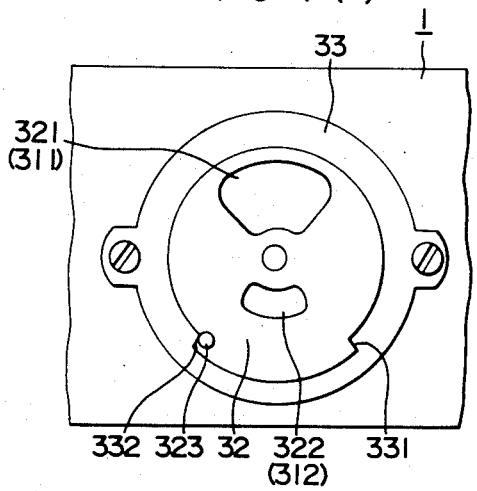

FIG. 7(*a*) is a sectional view representing the opening 3 of the hopper 1 in another embodiment of this invention, and FIG. 7(*b*) and FIG. 7(*c*) are rear elevations of the opening viewed from inside the hopper 1. In this embodiment, at the position where the projection 323 provided on the movable cover 32 comes in contact with the one stopper 331, the apertures 311, 312 of the opening body 31 do not coincide with the apertures 321, 322 which are provided on the movable cover 32 and closed completely as shown in FIG. 7(*b*).

Then, at the position where the projection 323 provided on the movable cover 32 comes in contact with the other stopper 332, the apertures 311, 312 of the opening body 31 will coincide with the apertures 321, 322 provided on the movable cover 32 and opened as shown in FIG. 7(*c*).

Figure 8A:
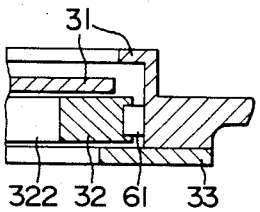
FIG. 8(*a*) is a sectional view representing a friction member provided between an opening body and a movable cover, and FIG. 8(*b*) is a sectional view of a detent provided thereon.
Figure 8B:
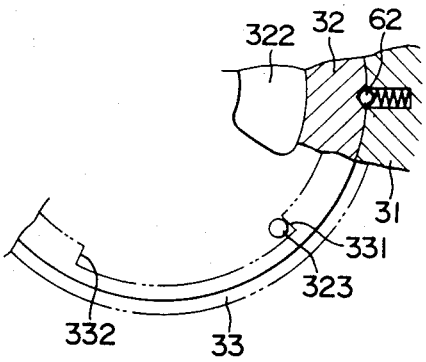

To prevent unexpected movement of the opening body 31, which is a fixed cover relative to the movable cover 32, an arrangement is provided so that a friction member 61 mode of felt or the like is provided on a sliding face of the movable cover 32 and the opening body 31 as shown in FIG. 8(*a*). Or, if preferred, a detent mechanism 62, such as a claw, pawl or the like, which is engaged with a notch provided separately, is provided between the opening body 31 and the movable cover 32 at a position where the projection 323 will come in contact with the stopper 331 or 332 as shown in FIG. 8(*b*).

Figure 9:
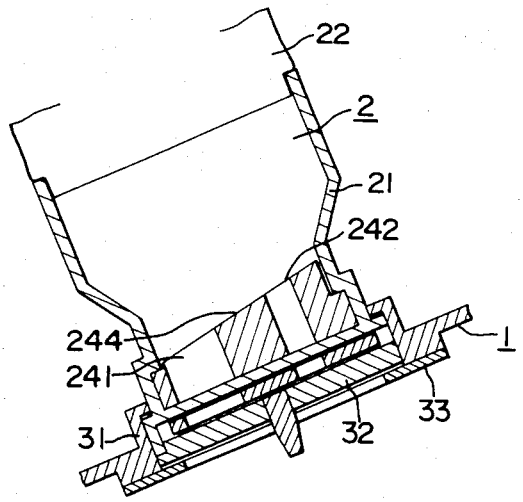
FIG. 9(*a*) is a sectional view representing the state wherein the developer receptacle is mounted on a hopper according to this invention, and FIG. 9(*b*) is a sectional view representing the state wherein the developer is being supplied.

FIG. 9(*a*) is a sectional view representing the state wherein the developer receptacle 2 is mounted on the hopper 1, and FIG. 9(*b*) is an explanatory drawing representing the state wherein the developer is supplied.

As described above, the hopper according to this invention is provided with two covers having a developer feeding aperture, the one operating as a fixed cover and the other as a movable cover. Opening and closing of the developer feeding aperture is effected by moving the movable cover, and a limiting member is provided to regulate the cover at open and close positions. This prevents the developer from leaking out at the time of supply, to say nothing of leakage during ordinary service, but also ensures superior operating efficiency by this embodiment.

Also in this embodiment, one of the two covers is constituted as a fixed cover and the other as a movable cover. However, it is conceivable that both the covers may be constituted as movable so as to operate the aperture by relative movement and that a limiting member for the relative movement of opening and closing can be provided between the two. Further, the movable cover of the hopper in this embodiment is disclosed as a rotatable slide member. However, a movable cover sliding linearly is also acceptable, and a construction wherein linear sliding operates the aperture and a limiting member is provided for limiting opening and closing is also included in the scope of this invention to to afford a similar effect as in the above case.

Further in this embodiment, the construction is such that a first movable cover (inner cover 24) and a first operating member (projection 235) are provided on the developer receptacle 2, and a second movable cover (movable cover 32) and a second working member (projection 315) are provided on the electrostatic reproducing apparatus. Thus, when the developer receptacle is installed on the electrostatic reproducing apparatus, the first operating member (projection 235) operates on the second movable cover (movable cover 32), and the second working member (projection 315) operates on the first movable cover (inner cover 24), thus forming an opening for the developer to flow through and descend. Thus, according to this invention, there is provided a developer feeder which is simple in operation at the time of toner supply, and has the advantages of operating accurately and preventing toner stain at the time of toner supply.

Figure 10:
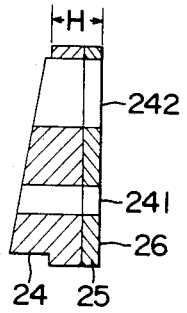
FIG. 10 is a sectional view of an inner cover according to a further embodiment of this invention.
Figure 9:
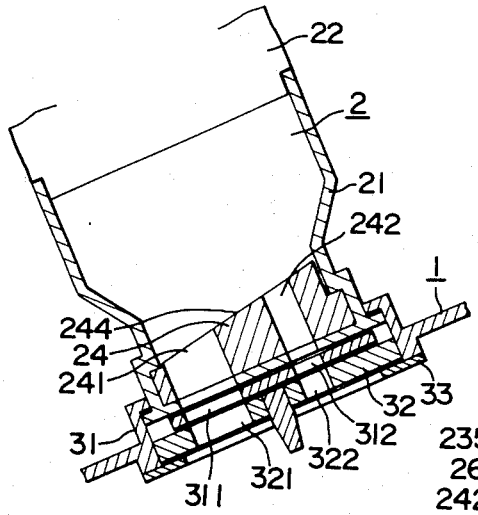
Figure 11:
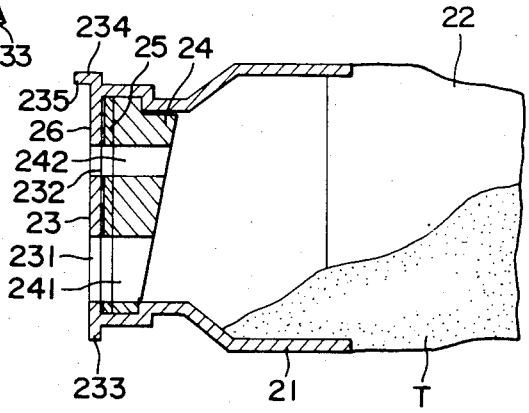
FIG. 11 is a sectional view of a dry developer receptacle.

FIG. 10 is a sectional view of another embodiment of this invention. The inner cover 24 has an elastic body 25, consisting of sponge rubber several mm thick or the like, which is applied on the side which comes in contact with the outer cover 23. A plastic film 26 consisting of polycarbonate film or the like is applied on its surface. Two openings 241, 242 corresponding to and the same in arrangement and shape as the openings 231, 232 of the outer cover 23, are provided on the inner cover 24 integral with the elastic body 25 and the plastic film 26 almost at symmetrical positions. FIG. 11 is a sectional view of a dry developer receptacle in this embodiment. The thickness of a fitting zone of the inner cover 24 provided on the developer discharge part 21 shown in FIG. 11 is made slightly smaller than the thickness H of the inner cover 24 to be inserted therein. Therefore, when the inner cover 24 is inserted, the elastic body 25 is compressed so as to slide closely adjacent with the outer cover 23.

On the other hand, when the inner cover 24 is rotated, smooth operation will be secured with a proper slidableness, as the plastic film 26 applied on the inner cover 24 through the elastic body 25 comes to slide with the outer cover 23.

Figure 12A:
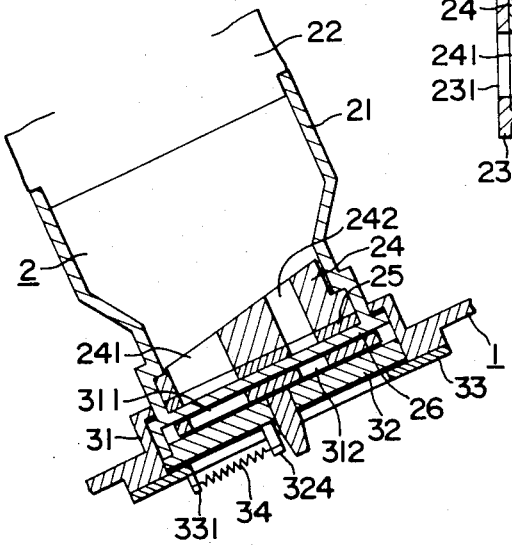
FIG. 12(*a*) is a sectional view representing the state wherein the developer receptacle is mounted on the hopper, and FIG. 12(*b*) is a sectional view representing the state wherein the developer is being supplied.
Figure 12B:
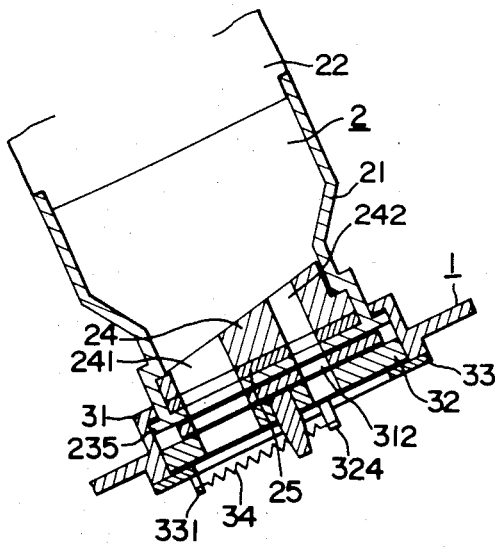

FIG. 12(*a*) is a sectional view representing the state wherein the developer receptacle 2 of this embodiment is mounted on the hopper 1, and FIG. 12(*b*) is an explanatory drawing representing the state of developer supply.

For the dry developer receptacle of this embodiment, the elastic body 25 is applied on the inner cover 24 as a sealing buffer member. However, it is conceivable that the elastic body 25 may be applied on the outer cover 23 so as to slide with the inner cover 24, which would produce a similar effect.

Also, the developer receiving part 22 comprises a transformable bag so that a quantity of developer to be discharged can be properly adjusted by hand from out-side without changing the position of the developer discharge part 21.

Figure 13A:
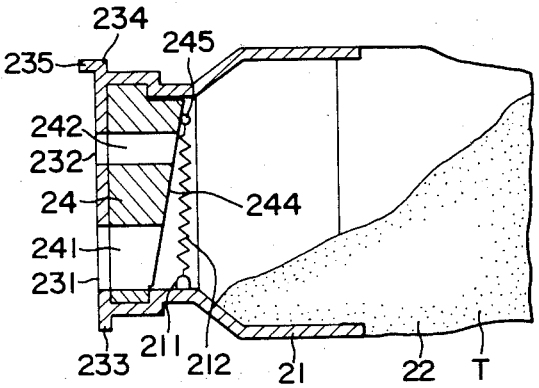
FIG. 13(*a*) is a sectional view of the developer receptacle mounted on a hopper in further embodiment of this invention, and FIGS. 13(*b*), 13(*c*) are front views thereof.
Figure 13B:
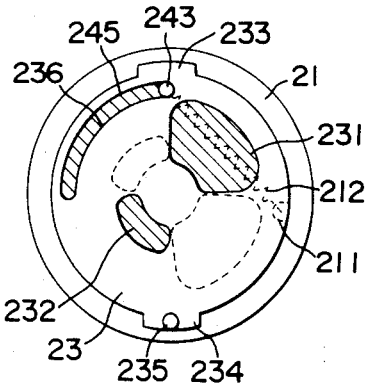
Figure 13C:
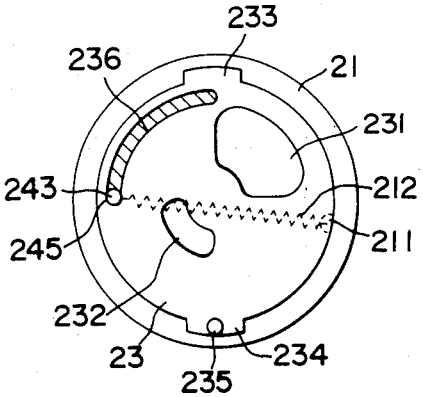

FIG. 13(*a*) is a sectional view of a dry developer receptacle in a further embodiment of this invention. In this embodiment, a separate projection 245 is provided on the tapered face 244 of the inner cover 24 to attach to a spring 212 which is also connected to a projection 211 provided on the developer discharge part 21. FIG. 13(*b*) is a front view of the developer receptacle 2 in its closed state wherein the blind hole 243 of the inner cover 24 is disposed at an end of the slot 236 of the outer cover 23 by the action of spring 212, and wherein the openings 231, 232 provided on the outer cover 23 are kept from coinciding with the openings 241, 242 of the inner cover 24 and are closed completely. Thus, the developer T will never leak out even when the dry developer receptacle is brought down.

When the developer receptacle 2 is mounted on the hopper 1, to be described later as having bayonets, the blind hole 243 is engaged with the projection 315 provided on the opening body 31 of the hopper. When turning the developer receptacle 2 against the bias of spring 212, the blind hole 243 rotates from one end to the other along the slot 236, and assumes the position as illustrated in FIG. 13(*c*). In FIG. 13(*c*), the openings 231, 241 and those 232, 242 of the outer cover 23 and the inner cover 24 are matched to coincide with each other, and thus the developer T in the dry developer receptacle can be discharged through the openings 231, 241 which serve as discharge ports.

As described, the developer receptacle 2 is normally kept closed. However, when it is installed on the hopper 1, it is opened against the bias of spring 212. Therefore, it will be closed automatically and so kept by the bias of spring 212 when the receptacle is demounted from the hopper 1.

Figure 14:
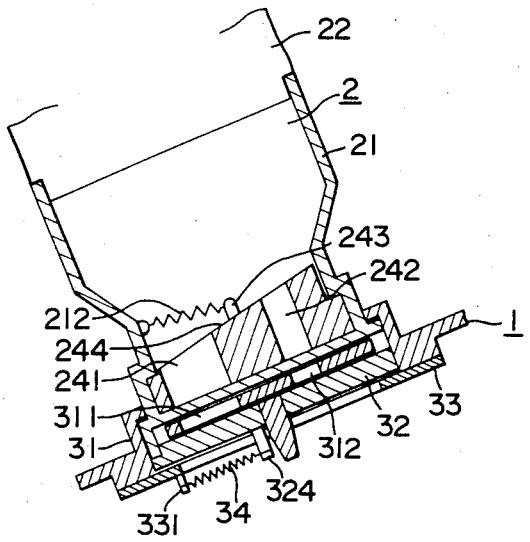
FIG. 14(*a*) is a sectional view representing the state wherein the developer receptacle is mounted on the hopper, and FIG. 14(*b*) is an explanatory drawing representing the state wherein the developer is being supplied.
Figure 14:
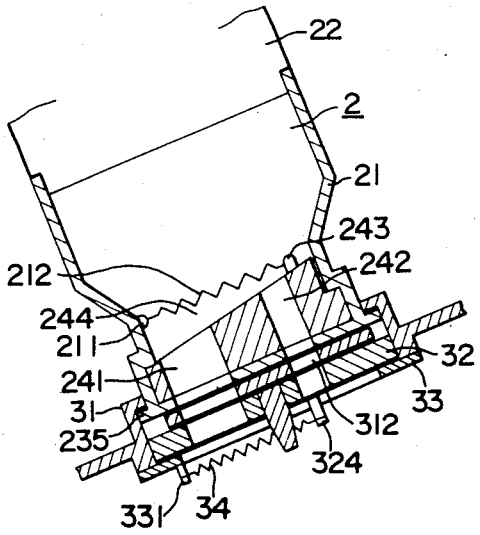

FIG. 14(*a*) is a sectional view representing the state wherein the developer receptacle 2 is mounted on the hopper 1, and FIG. 14(*b*) is an explanatory drawing representing the state of developer supply.

In this device, a tension spring is used for effecting closing movement of the movable cover of the developer receptacle. However, it is not necessarily so limited, and a detent type spring which operates to keep the cover either closed or open can also be used and is included in the scope of this invention.

What is claimed is:

1. In combination:

a developer supplying device for electrostatic reproducing apparatus comprising:

an opening for receiving developer;

a rotatable device cover on said device movable to open and closed positions relative to said opening;

spring means for biasing said device cover to closed position;

and an operating member on said device cover actuatable to move said device cover to open position;

and a dry developer receptacle for attachment to said device and comprising:

means to releasably connect said receptacle to said device;

means to actuate said operating member to move said device cover to open position when said receptacle is attached to said device;

an inner cover and an outer cover on said receptacle, said covers being rotatable relative to each other;

said inner cover comprising an inner face including a sloped portion and an outer face;

said inner face of said inner cover defining a bottom wall of said receptacle when said receptacle is inverted and attached to said device;

said inner cover being provided with a developer discharge hole from which developer is able to flow from said container through said opening in said device and an air inlet hole through which air is able to flow into said container through said opening in said device when said container is inverted and connected to said device, each of said holes extending between said outer face and said inner face, said developer discharge hole terminating at said sloped portion of said inner face of said inner cover near the lower end of said sloped portion;

said outer cover comprising an inner face and an outer face;

said inner face of said outer cover confronting said outer face of said inner cover;

said outer cover being provided with a pair of holes, moving means, engaging said operating member on said device cover, to move at least one of said inner and outer covers relative to the other cover between an open position wherein each hole in said outer cover registers with one hole in said inner cover and a closed position wherein neither hole in said outer cover registers with any hole in said inner cover;

and biasing means for biasing said inner and outer covers toward said closed position.

2. A combination according to claim 1 including means on said developer supplying device for actuating said moving means on said receptacle to effect movement of said at least one of said inner and outer covers when said receptacle is connected to said device.

3. A combination according to claim 1 or 2 including interengaging means on said covers to limit relative motion between said covers after said at least one movable cover is in open or closed position.

4. A combination according to claim 1 or 2 including sealing buffer means disposed between said inner and outer covers.

5. A combination according to claim 4 wherein said sealing buffer means comprises an elastic base member and a plastic low friction member adjacent one side of said base member.

6. A combination according to claim 1 wherein said means to releasably connect said receptacle to said device comprises a bayonet type coupling member.

7. A combination according to claim 6 wherein said bayonet type coupling member is integral with said outer cover.

8. In combination:

a developer supplying device for electrostatic reproducing apparatus comprising:

an opening for receiving developer;

a device cover on said device movable to open and closed positions relative to said opening;

spring means for biasing said device cover to closed position;

and an operating member on said device cover actuatable to move said device cover to open position;

and a dry developer receptacle for attachment to said device and comprising:

means to releasably connect said receptacle to said device;

means to actuate said operating member to move said device cover to open position when said receptacle is attached to said device;

an inner cover and an outer cover on said receptacle, said covers being rotatable relative to each other;

said inner cover comprising an inner face including a sloped portion and an outer face;

said inner face of said inner cover defining a bottom wall of said receptacle when said receptacle is inverted and attached to said device;

said inner cover being provided with a developer discharge hole from which developer is able to flow from said container through said opening in said device and an air inlet hole through which air is able to flow into said container through said opening in said device when said container is inverted and connected to said device, each of said holes extending between said outer face and said inner face, said developer discharge hole terminating at said sloped portion of said inner face of said inner cover near the lower end of said sloped portion;

said outer cover comprising an inner face and an outer face;

said inner face of said outer cover confronting said outer face of said inner cover;

said outer cover being provided with a pair of holes, moving means to move at least one of said inner and outer covers relative to the other cover between an open position wherein each hole in said outer cover registers with one hole in said inner cover and a closed position wherein neither hole in said outer cover registers with any hole in said inner cover;

and means on said developer supplying device for actuating said moving means on said receptacle to effect movement of said at least one of said inner and outer covers when said receptacle is connected to said device.

9. A combination according to claim 8 including inter-engaging means on said covers to limit relative motion between said covers after said at least one movable cover is in open or closed position.

10. A combination according to claim 8 including means to bias said at least one movable cover to closed position.

11. A combination according to claim 8 including sealing buffer means disposed between said inner and outer covers.

12. A combination according to claim 11 wherein said sealing buffer means comprises an elastic base member and a plastic low friction member adjacent one side of said base member.

13. A combination according to claim 8 or 9 or 10 or 11 or 12 further comprising a rigid developer discharge part on which said inner and outer covers are mounted and a developer receiving part comprising a bag which is connected to said developer discharge part.

14. A combination according to claim 13 wherein said outer cover is integral with said rigid developer discharge part and wherein said inner cover is rotatably movable relative thereto.

15. A combination according to claim 8 wherein said means to releasably connect said receptacle to said device comprises a bayonet type coupling member.

16. A combination according to claim 15 wherein said bayonet type coupling member is integral with said outer cover.

* * * * *